United States Patent [19]

Marchese et al.

[11] Patent Number: 4,548,107

[45] Date of Patent: Oct. 22, 1985

[54] MEAT SLICING MACHINE AND METHOD

[75] Inventors: Gerald R. Marchese, Elmhurst, Ill.; Richard B. Calhan, Warsaw, Ind.

[73] Assignee: Auto-Indexer, Elmhurst, Ill.

[21] Appl. No.: 532,241

[22] Filed: Sep. 14, 1983

[51] Int. Cl.[4] ..... B26D 7/30; B26D 7/01

[52] U.S. Cl. ..... 83/23; 83/42; 83/73; 83/74; 83/77; 83/278; 83/467 R; 83/415; 83/717

[58] Field of Search ..... 83/77, 23, 72–74, 83/276, 273, 410, 467 R, 412, 467 A, 415, 468, 83/714, 717, 718, 719, 721, 730, 390, 42; 269/24–27

[56] References Cited

U.S. PATENT DOCUMENTS

| | | | |
|---|---|---|---|
| 1,807,313 | 5/1931 | Hines | 83/77 |
| 2,075,554 | 3/1937 | Strauhan | 83/730 |
| 3,363,656 | 1/1968 | Snyder | 83/73 |
| 3,568,745 | 3/1971 | Johnson | 83/718 |
| 3,713,470 | 1/1973 | Muller | 83/718 |
| 3,797,353 | 3/1974 | Calhan | 83/718 |
| 4,009,631 | 3/1977 | Ekholm | 83/390 X |
| 4,136,504 | 1/1979 | Wyslotsky | 83/77 X |

FOREIGN PATENT DOCUMENTS

| | | | |
|---|---|---|---|
| 716789 | 12/1931 | France | 83/718 |

*Primary Examiner*—James M. Meister
*Assistant Examiner*—John L. Knoble
*Attorney, Agent, or Firm*—Flynn, Thiel, Boutell & Tanis

[57] ABSTRACT

A machine and method wherein a pusher advances a piece of meat to be sliced across the plane of a slicing blade against a backstop. The blade removes a slice from the piece. The difference between the slice weight and a preselected reference weight is used to adjust the separation of the backstop from the plane of the slicing member and hence the thickness of the next slice to be cut from the piece so as to tend to closely conform the weight of the next slice to the reference weight. Clamps hold the piece during slicing but release to allow the pusher to again advance the piece for production of the next slice. The pusher is actuable for ejecting a residual butt portion of the piece to enable loading of a new piece.

20 Claims, 20 Drawing Figures

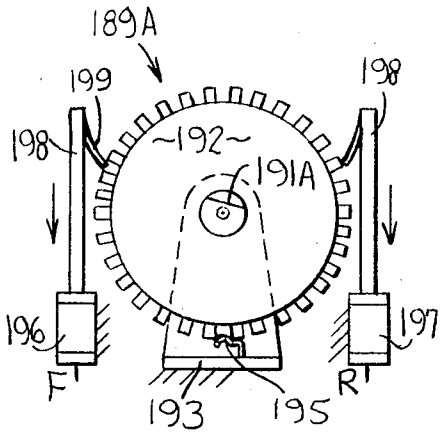
FIG. 10A
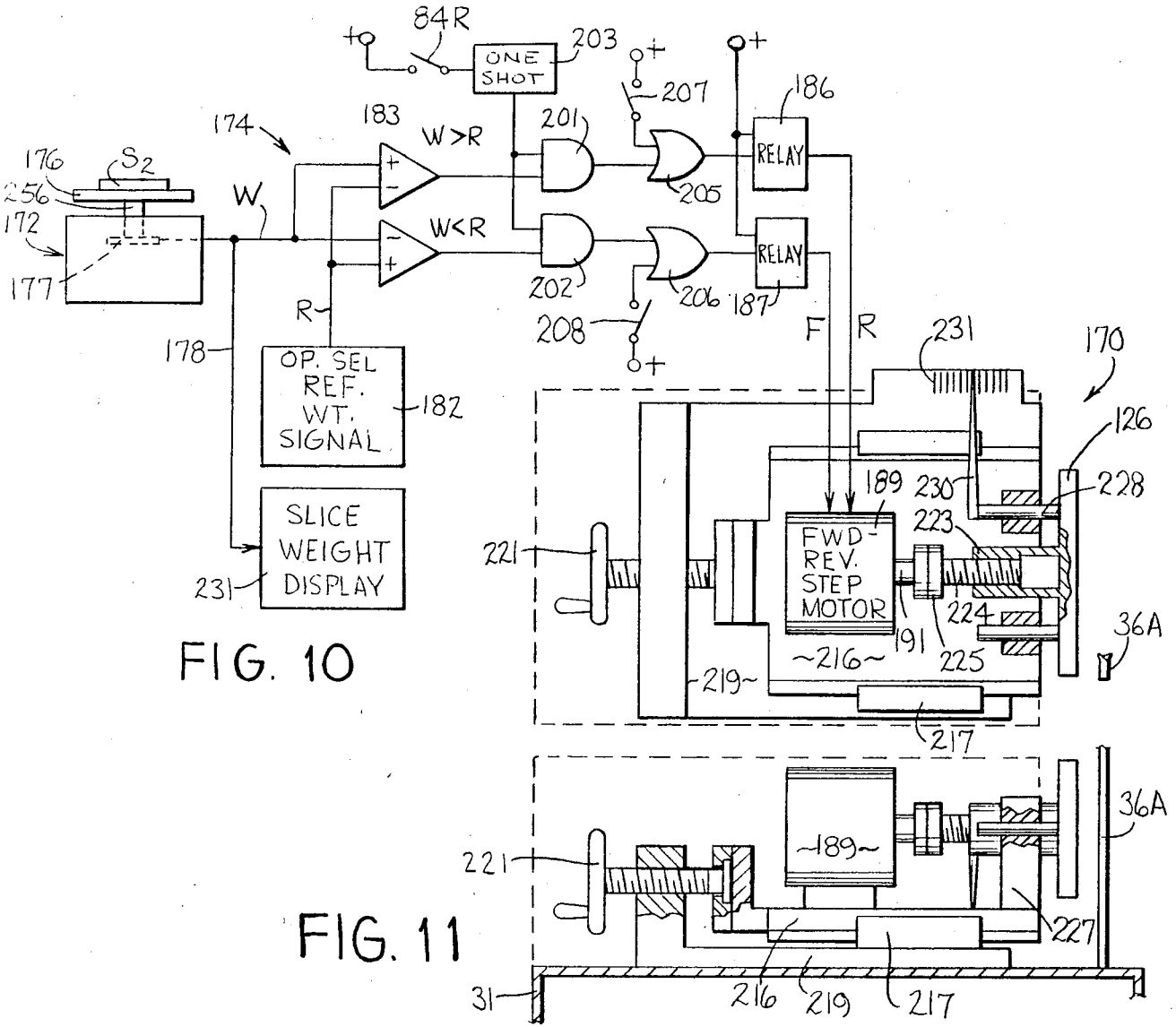
FIG. 10
FIG. 11

MEAT SLICING MACHINE AND METHOD

FIELD OF THE INVENTION

This invention relates to a system, particularly a machine and method, for automatically sawing or cutting an object into slices which are removed from the cutting zone and, more particularly, for removing slices from a piece of meat.

BACKGROUND OF THE INVENTION

U.S. Pat. No. 3,797,353 of present co-inventor R. B. Calhan of the present application discloses a prior meat slicing machine in which a trough, for supporting a large piece of meat to be sliced, is supported for movement along a rectangular orbit adjacent the saw blade. An electric motor driven mechanical linkage (including cam, crank and rack elements) cycles the trough through its rectangular orbit and coordinately advances the piece of meat toward the plane of the saw blade by fixed length steps for the purpose of removing fixed thickness slices. The slices fall onto and are removed from the blade area by a conveyor. Elongate leaf springs fixed above the trough continuously press down on the piece of meat adjacent the blade to help hold same in position during slicing.

While the above-mentioned patented machine provided generally satisfactory performance for its intended purpose, nevertheless a continuing effort has been made to further develop and improve machines of this general kind.

Accordingly, the objects and purposes of this invention include provision of the following.

A meat slicing system for automatically varying the thickness of successive slices to maintain substantially the same preselected weight for a number of successively produced slices.

A system as aforesaid in which substantially constant weight slices are achieved by comparing the weight of a freshly produced slice with a preselected weight reference and compensatingly adjusting a backstop plate governing the advancement of a piece of meat beyond the plane of the blade to so change the slice thickness in such direction as to tend to reduce the difference between slice weight and the preselected weight reference.

A system as aforesaid capable of rejecting a portion of the piece of meat, for example a preset thickness thereof remaining after the major portion of the piece of meat has been sliced.

A system as aforesaid in which the major moving components of the machine are powered by a common energy source, such as compressed air.

A system as aforesaid in which the piece of meat is pushed toward the plane of the saw blade by rotation of a compressed air driven motor and in which the trough is moved through its rectangular orbit by extension and retraction of a pair of mutually orthogonal air cylinders.

A system as aforesaid in which the piece of meat is clamped and unclamped with respect to the trough by compressed air cylinders extensible and retractable in coordination with movement of said trough through portions of its rectangular orbit.

Other objects and purposes of this invention will be apparent to persons acquainted with apparatus of this general type upon reading the following specification and inspecting the accompanying drawings.

The objects and purposes of this invention are met by providing a machine and method wherein a pusher advances a piece to be sliced across the plane of a slicing member against a backstop. The slicing member removes a slice from the piece. The difference between the slice weight and a preselected reference weight is used to adjust the separation of the backstop from the plane of the slicing member and hence the thickness of the next slice to be cut from the piece. Clamps hold the piece during slicing but release to allow the pusher to again advance the piece for production of the next slice. The pusher is actuable for ejecting a residual butt portion of the piece to enable loading of a new piece.

BRIEF DESCRIPTION OF THE DRAWINGS

FIG. 10 is a top view of a backstop assembly and a connected control circuit schematic, useable in the FIG. 1 machine.

FIG. 10A is an elevational view of a rotatable stepping motor useable in the backstop assembly of the FIG. 1 machine.

FIG. 11 is a side elevational view of the FIG. 10 backstop assembly.

DETAILED DESCRIPTION

Figure 1:
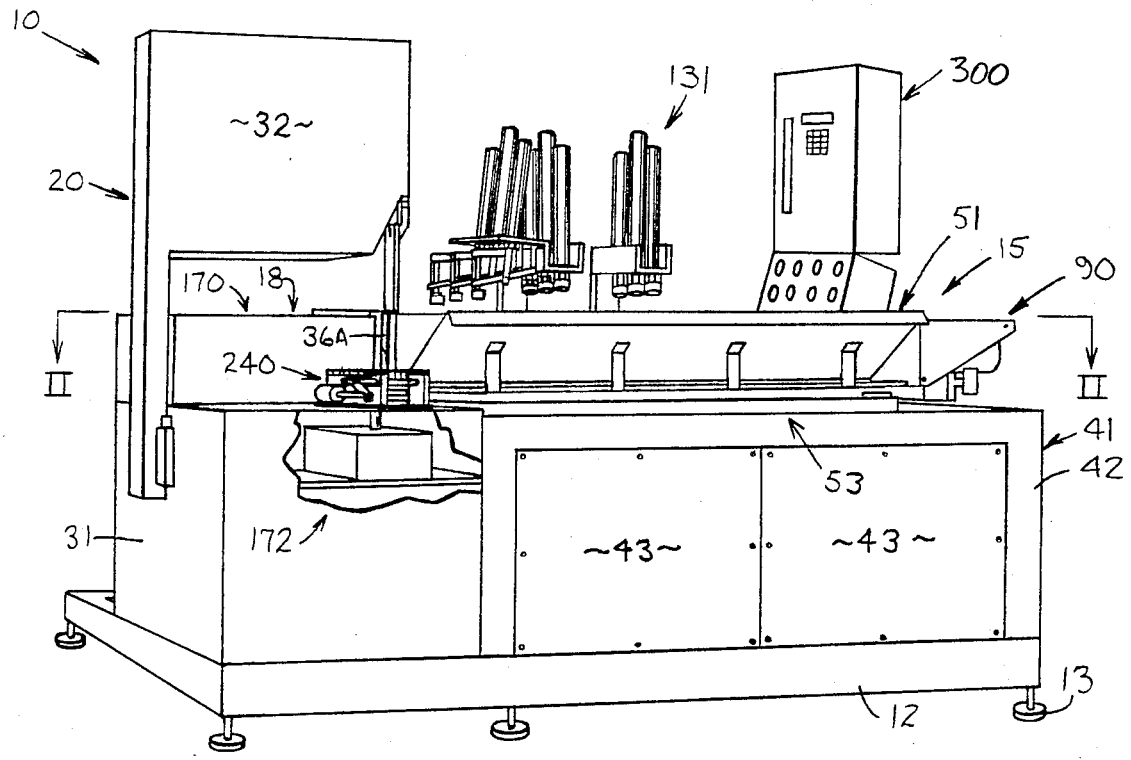
FIG. 1 is a perspective view of an automatic meat slicing machine embodying the invention, taken from the rear side and output end thereof.
Figure 2:
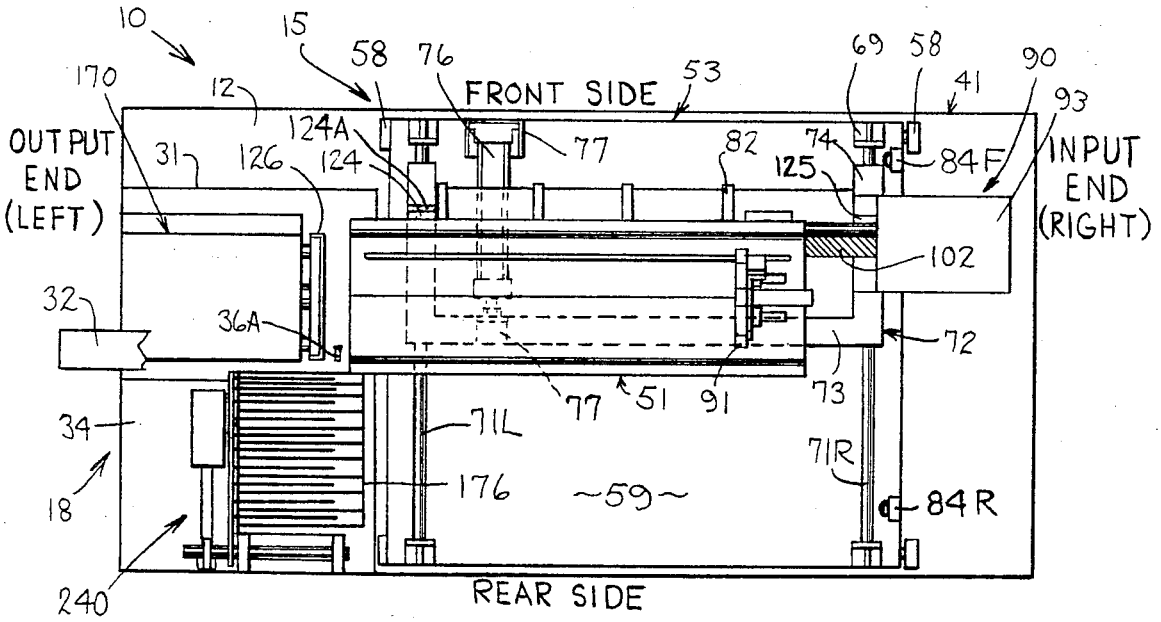
FIG. 2 is a sectional view substantially as taken on the line II—II of FIG. 1 and looking down on the meat trough, backstop assembly and scale.
Figure 2A:
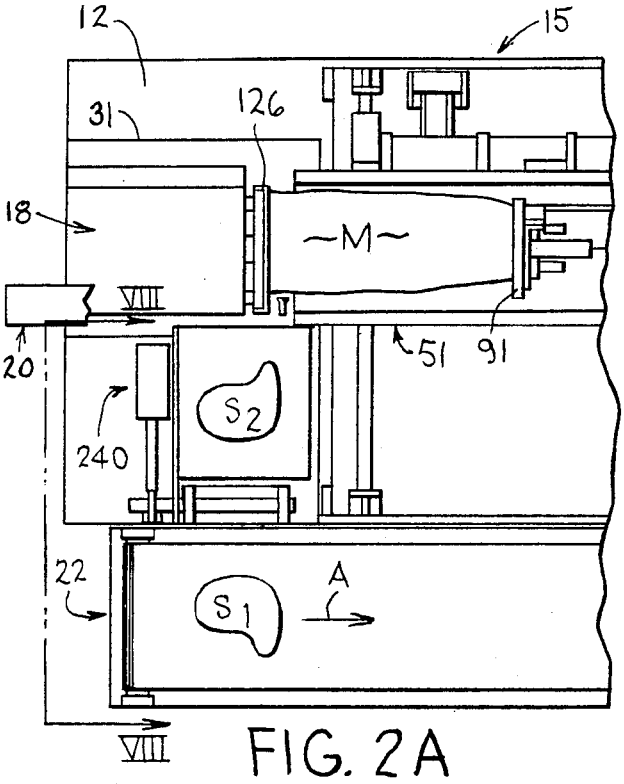
FIG. 2A is a fragment of FIG. 2 showing the machine in use with a piece of meat being sliced.
Figure 8:
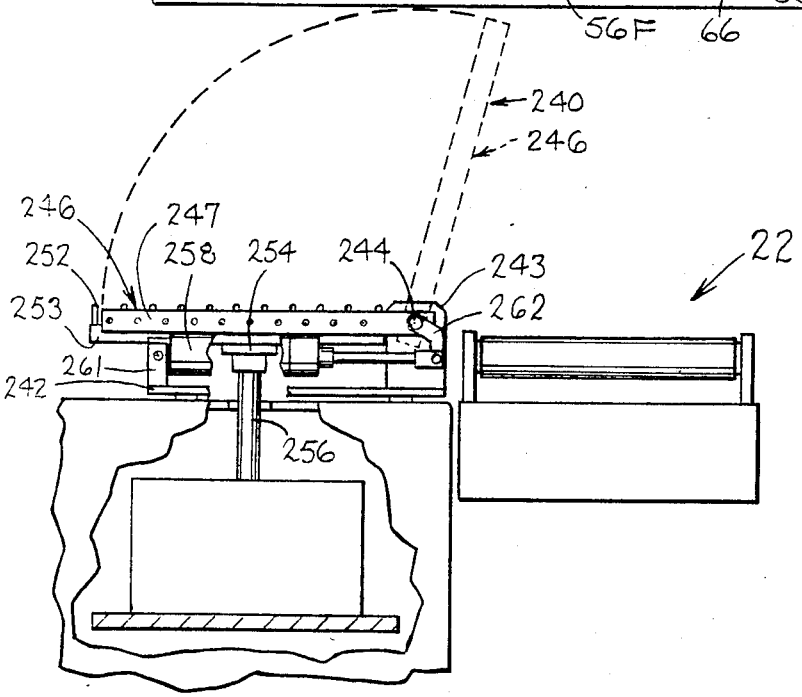
FIG. 8 is a sectional view of reduced scale substantially as taken on the line IX—IX of FIG. 9 and showing in end elevation the meat unloader in connection with an output conveyor.

FIGS. 1 and 2 disclose an automatic meat slicing machine 10 embodying the invention. The machine 10 includes several main units fixedly located with respect to each other, preferably on a common horizontal rectangular subframe 12 conventionally supported by adjustable height feet 13. These main units include a meat feeding unit 15, a slice weight control unit 18 and a slicing unit 20, the elements of which cooperate to convert a large chunk of meat M (FIG. 2A) for example a pork loin, into a plurality of successive slices $S_1$,$S_2$, etc. of substantially uniform weight, despite differences in slice width or length due to changes in cross-sectional shape and area of the piece of meat M along its length. A typical pork loin, for example, tapers from end to end and if the slices are of constant thickness, they will very in weight whereas slices of constant preselected weight are desired. After weighing, the successive slices $S_1$,$S_2$, etc are removed, as by conveyor 22 (FIGS. 2A and 8). In the embodiment shown, the conveyor 22 is a conventional, continuous running horizontal belt conveyor led along the rear side of the machine 10 in the direction of arrow A.

Figure 3:
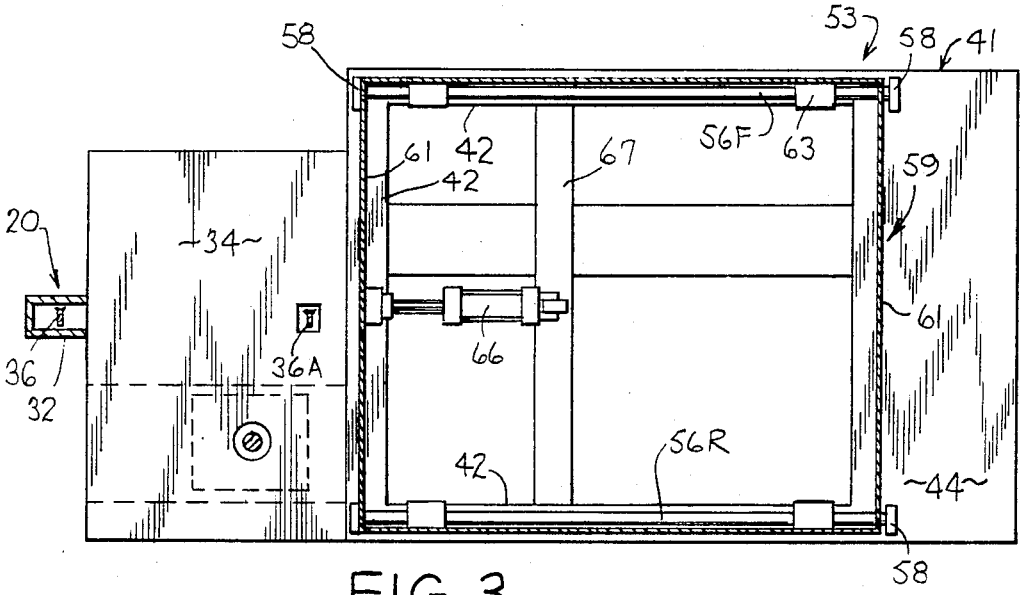
FIG. 3 is a sectional view essentially taken on the line III—III of FIG. 7 and showing the mounting of the lower table for reciprocation toward and away from the plane of the saw blade to perform the blade approach and release strokes.

The slicing unit 20 is, in the embodiment shown, a conventional meat cutting unit of "bandsaw" type, preferably similar to the sawing machine disclosed in prior U.S. Pat. No. 797,353. Slicing units of other than saw or bandsaw type are contemplated. The slicing unit 20 includes a hollow pedestal cabinet 31 fixedly upstanding from the output end of subframe 12 (FIGS. 1–3). An inverted L-shaped column 32 extends fixedly up from the output end of cabinet 31 with its upper portion spaced above the horizontal top 34 of the cabinet. The bandsaw 20 conventionally includes a saw drive motor (not shown) housed in the cabinet 31 and connected to drive the saw band 36 orbitally, the saw band being supported on conventional pulley wheels (not shown) in the overlying portion of column 32 and in cabinet 31. Thus, one reach 36A (the rightward one in FIGS. 1–3) runs downward in a cutting manner from the input end of column 32 loosely through a small opening in the top 34 of cabinet 31 for slicing a piece M of meat advanced in a rearward direction (toward the bottom of the paper and toward conveyor 22 in FIG. 2A).

The meat feeding unit 16 comprises a further cabinet 41 comprising an upstanding rectilinear frame 42 (FIG. 1) fixed upon the subframe 12 and extending substantially the front-to-rear width thereof and from the input end thereof leftwardly in FIGS. 1 and 2 substantially to the slicing unit pedestal cabinet 31. The sides of the further, or feeding unit support, cabinet 41 may be closed by removable panels 43 (FIG. 1). In the embodiment shown, the rectilinear frame 42 is of angle cross-section members (FIGS. 1 and 3), the rightward portion of the top of the frame 42 being covered by a horizontal deck 44 (FIG. 3) and the mid and left portions of the top of the frame being, in the embodiment disclosed in FIG. 3, open to the interior of the cabinet.

The meat feeding unit 16 includes a rightward-leftward extending, elongate, generally V cross-section, upward opening trough 51 (FIGS. 1 and 2) supported on and spaced above the frame 42 for horizontal movement in a rectangular path by a trough orbit assembly 53 (FIGS. 1–3 and 7). The orbit assembly 53 comprises parallel front and rear slide bars 56F and 56R (FIGS. 3 and 7) spaced above the front and rear top frame members 42, respectively, and anchored at their ends thereto by upstanding brackets 58. A lower table 59 is here of rectilinear inverted (downwardly opening) shallow box-shape having sides 61 depending skirtlike from a horizontal top 62. Fixedly depending from the lower table, at points spaced inboard from the right and left ends thereof, are four slide blocks 63 (FIGS. 3 and 7) which secure the lower table 59 for rightward-leftward sliding moment along and above the front and rear slide bars 56R and 56F, the blocks 63 being spaced more closely along the slide bars 56 than the upstanding brackets 58 to permit sufficient movement of the trough 51 toward and away from the saw blade 36A. A lower pressure fluid cylinder 66 is anchored at one end to a front-rear cross member 67 (FIG. 3) of the frame 42 and extends leftwardly, with the free end of its piston rod fixed to the leftward skirt 61 of the lower table 59 such that extension and retraction of the cylinder 66 alternately shifts the trough leftward and rightward and hence toward and away from the saw blade 36A.

Upstanding brackets 69 fixed atop the four corner areas of the lower table 59 (FIGS. 2 and 7) fixedly support a pair of spaced, parallel, front-to-rear slide bars 71L and 71R adjacent the left and right edges of the lower table 59. A horizontal upper table 72 (FIGS. 2, 5 and 7) is, in the particular embodiment shown, substantially formed as a rectangular for framework of downward opening channel members 73 extending right to left with front-rear extending end members 74 incorporating slide blocks slidably supporting the upper table 72 for front-rear movement on the slide bars 71. A front-rear (or upper) pressure fluid cylinder 76 (FIGS. 2 and 7) is fixed at one end by a bracket 77 upon the front portion of lower table 59 and has a piston rod whose free rear end is fixed by a bracket 77 to the underside of upper table 72 for moving upper table 72 forwardly and rearwardly with respect to lower table 59 and also with respect to saw blade 36A.

Figure 5A:
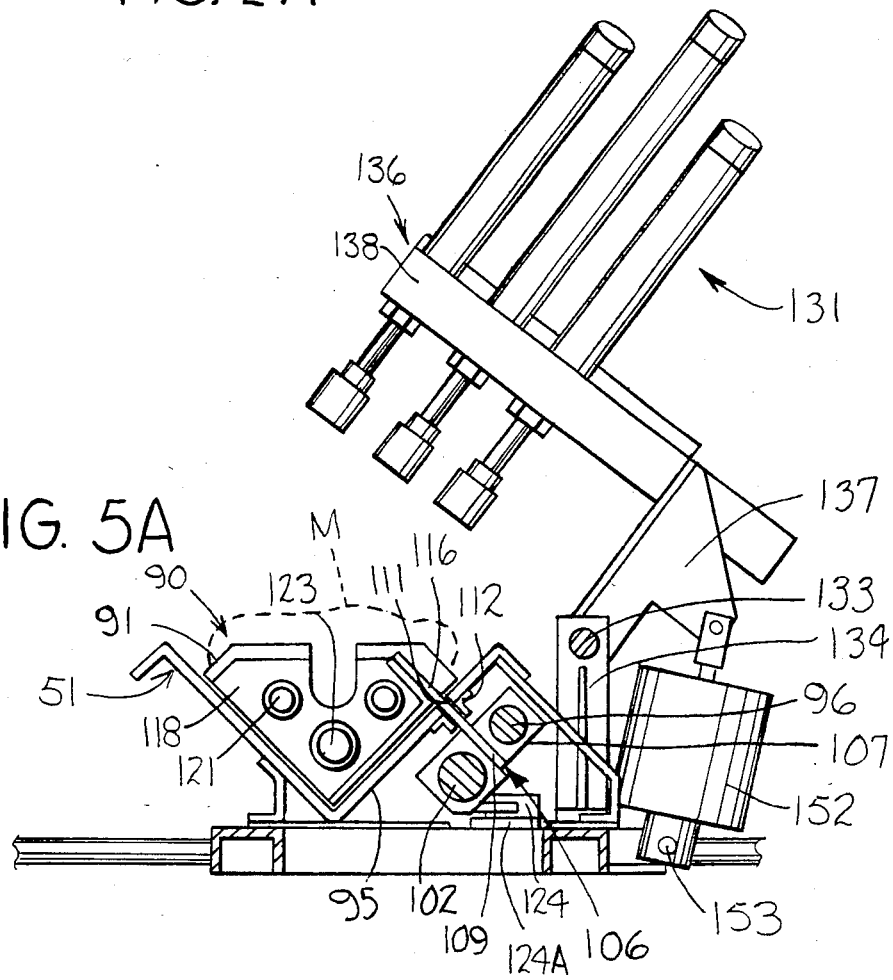
FIG. 5A is an enlargement of FIG. 5 showing the meat clamp assembly open.
Figure 5:
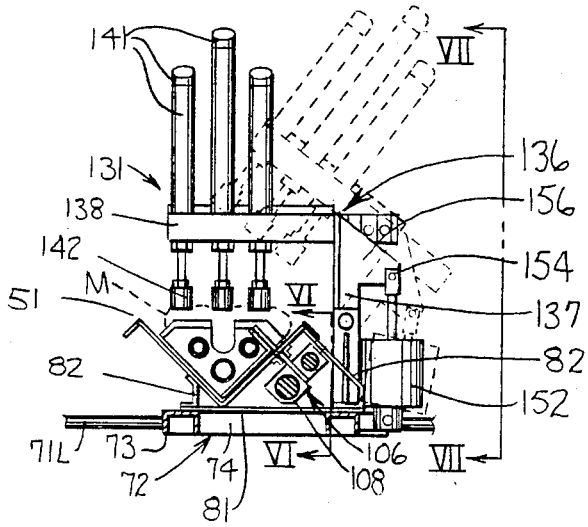
FIG. 5 is a sectional view substantially taken on the line V—V of FIG. 4, showing the upstream end of the meat trough and meat pusher assembly and showing the meat clamp assembly in alternate closed (solid line) and open (dotted line) positions.

The trough 51 is fixed upon the upper table 72 by rigid horizontal straps 81 and upstanding brackets 82 (FIG. 5). The cylinders 66 and 76 have positions and stroke length selected to move the trough 51 through a rectangular orbit with the stopping points at the corners of the rectangular orbit being precisely located with respect to the underlying subframe 12. In FIG. 2, for example, trough 51 is shown in the early part of its rearward stroke (toward the bottom of the page in FIG. 2) in which the left edge of the trough is close to and moves rearward past the cutting reach of the blade 36A. After completing its movement past the blade 36A, the trough 51 stops with cylinder 76 extended. Retraction of cylinder 66 then acts through both tables to pull the trough rightwardly away from the plane of the blade. Then, cylinder 76 retracts to pull the upper table and trough 51 forward (toward the top of the page in FIG. 2). Then, cylinder 66 extends to move both tables and the trough 51 leftwardly in FIG. 2 to bring the left end of trough 51 near blade 36A again. Then, cylinder 76 is extended once more to move the upper table and trough 51 rearwardly past its FIG. 2 position in a second cycle of operation. The cylinders 66 and 76 are preferably double-acting cylinders. The cylinders 66 and 76 may be sequenced as desired, for example by use of conventional limit sensors (such as limit switches acting through flow controlling solenoid valves or such as limit valves) sensing that the trough 51 has completed each leg of its rectangular orbit before actuating the appropriate pressure fluid cylinder 66 or 76 to initiate the next leg of such rectangular orbit. Such limit sensors may be mounted as desired, as at 83 and 84 in FIGS. 7 and 2, to be actuated by approach of surfaces on the respective lower and upper tables 59 and 72.

Figure 2B:
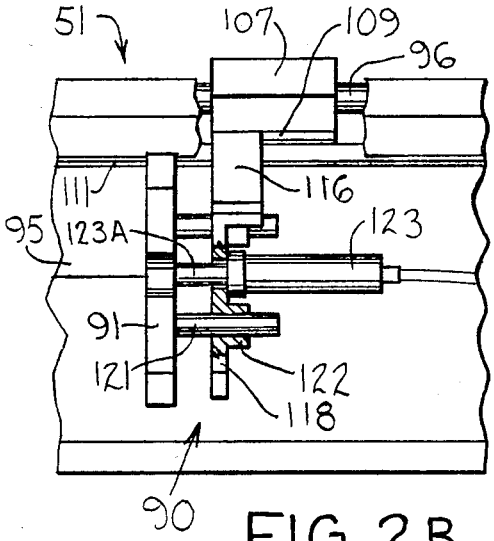
FIG. 2B is an enlarged fragment of FIG. 2 showing the pusher assembly.

The meat feeding unit 16 includes a pusher assembly 90 (FIGS. 2B, 5A and 6) having a pusher plate 91 for advancing the piece of meat M along the trough 51 toward the slice weight control unit 18 and slicing unit 20 to produce successive slices $S_1$,$S_2$, etc.

Figure 6:
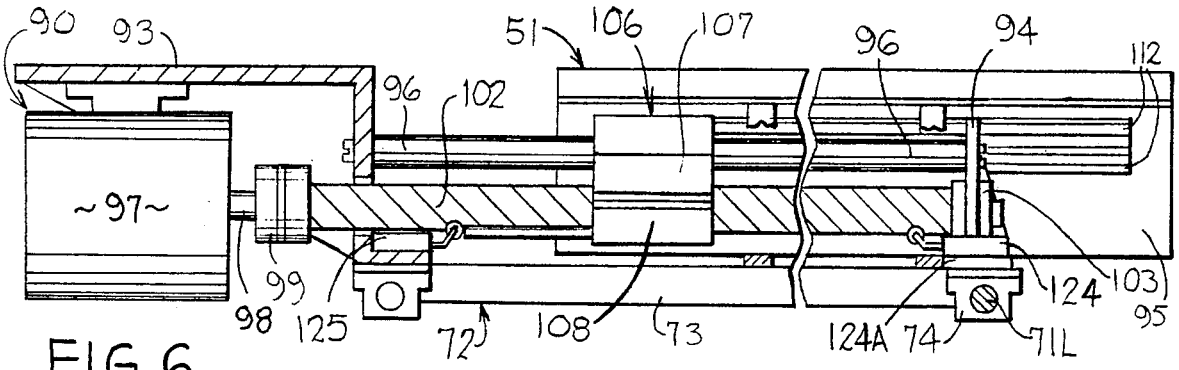
FIG. 6 is an enlarged, partly broken, fragmentary sectional view taken in front elevation on substantially the line VI—VI of FIG. 5 to show the meat trough and associated feed mechanism for the meat pusher thereof.
Figure 7:
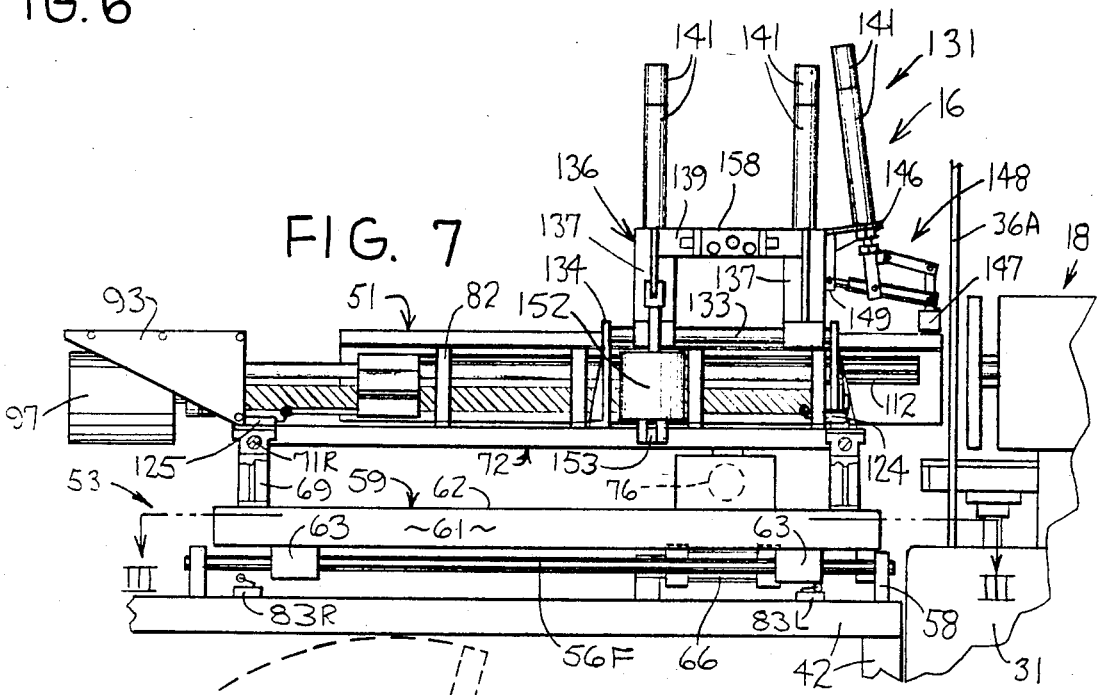
FIG. 7 is a sectional view taken on the line VII—VII of FIG. 5, in front elevation, and further showing the meat clamp assembly as well as the mounting of the meat trough upon the orthogonally reciprocating upper and lower tables.

The pusher assembly 90 shown in FIGS. 5A and 6 includes upstanding brackets 93 and 94 (FIG. 6) fixed at opposite ends of the upper table 72. A horizontal guide rod 96 is fixed at its opposite ends to the upper portions of brackets 93 and 94 and extends parallel to and near the front wall 95 of the trough 51. Fixedly mounted on the bracket 93 is a motor 97 (FIG. 6) having a rotatable output shaft 98 which, through a coupling 99, supports and rotatably drives the input end (left in FIG. 6 and right in FIG. 2) of a lead screw 102. The lead screw 102 here extends loosely through an opening in the vertical wall of bracket 93 parallel to and below the slide rod 96 and in front of the trough 51. The free, output end of the lead screw 102 is rotatably supported by a bearing 103 on the bracket 94 near the output end of the trough. If desired, the driven end of lead screw 96 may be supported by an additional bearing on bracket 93, but in the embodiment shown the bearings of motor 97 serve to rigidly radially locate the driven end of the lead screw.

A carriage 106 (FIGS. 5A and 6) extends longitudinally of and is axially slidably guided at its upper end 107 on the slide rod 96 which passes axially therethrough. The lower carriage portion 108 acts as a nut threadedly engaged on and surrounding the lead screw 102 for advancing axially toward and retracting axially away from the output end bracket 94 and output end of trough 51. The carriage 106 further includes a flat rigid blade 109 (FIG. 5A) which angles upwardly and leftwardly in FIG. 5A from the carriage 106 through a longitudinally extending slot 111 (FIGS. 4 and 5A), which slot 111 runs almost but not quite from end to end of the trough 51. In the embodiment shown, angle cross-section members 112 are fixed to the front wall 95 of the trough 51 at the top and bottom edges of the slot 111 to reinforce the latter and prevent rapid wear thereof as the blade 106 slides longitudinally of the trough. The free upper end of the blade 109 is fixed to a bracket 116 (FIGS. 2B and 5A) which rigidly supports an inverted triangular backing plate 118 centrally within the trough 51. The shape of the backing plate 118, looking longitudinally of the trough in FIG. 5A, conforms to the cross-sectional shape of the trough. In the embodiment shown, the backing plate 118 clears the sides of the trough 51 and is supported for movement longitudinally in the trough with the carriage 106.

The pusher plate 91 is axially movably mounted on the leftward (FIGS. 2 and 2B) face of the backing plate 118 to engage the trailing end of a piece of meat M, as shown in FIG. 2A. In the embodiment shown, a pair of pins 121 fixed to the rear face of the slide plate 91 extend longitudinally of the trough 51 in slidably supported relation through bosses 122 in the backing plate 118. A pressure fluid cylinder 123 (FIG. 2B) is mounted on the right side of backing plate 118 and has the free end of its piston rod 123A fixed to the pusher plate 91. The cylinder 123 is preferably a pressure fluid extended, internal spring retracted unit actuable for pushing the pressure plate 91 leftwardly away from the backing plate 118, in the direction of the slice weight control and slicing units 18 and 20 (FIG. 2A), for discharging from the trough a residual portion of the piece of meat M, left over after all desired slices have been removed from the piece M. The pusher plate 91 will normally thus lie rightwardly against the backing plate 118 in the idle and normal slicing modes of the machine and typically will not be extended therefrom into its FIG. 2B position except for discharging the residual portion of the meat piece M. The pusher plate 91 and backing plate 118 both substantially match the cross-sectional V configuration of the trough 51 and are supported in clearance relation from the interior walls of the trough entirely by the blade 109, the carriage 106 and the slide bar 96 and lead screw 102, so as not to scuff same during longitudinal movement along the trough by the blade 109.

To reduce frictional drag between the piece of meat M and the interior walls of the trough 51, such interior trough walls may be coated with a suitable, friction-reducing coating of a kind which does not contaminate the meat M to be sliced. A Teflon coating is, for example, contemplated.

The motor 97 is capable of rotating relatively slowly to advance the carriage 106 and a piece of meat M in front of the pusher plate 91 relatively slowly toward the slice weight control unit 18 (FIG. 2A) each time a slice is to be removed from the output end of the meat piece M. The motor 97 is capable of rotation in the reverse direction at a substantially higher speed for retracting the pusher plate 91 away from the slice weight control unit 18 after a piece of meat M has been completely sliced and the residual end thereof has been ejected from the output end of the trough by actuation of the pressure fluid cylinder 123. In this way, the pusher plate 91 can be rapidly retracted to allow quick reloading of the trough 51 with a new piece of meat M to be sliced.

In the embodiment shown, limit sensors 124 and 125 (FIG. 6) are mounted adjacent the output and input ends of the upper table in the path of the carriage 106 to sense when the latter reaches the ends of its desired range of travel. At least the output end limit switch 124 is mounted for adjustment parallel to the carriage path (e.g. by means of a conventional slotted mounting plate schematically shown at 124A in FIG. 6) to select the length of the residual end of meat piece M to be rejected.

In addition, the motor 97 has a relatively precisely presettable stall torque, such that, if the force required to advance the pusher plate rises to a preset value, the rotation of motor shaft 98 and screw 102 will cease, as will forward advancement of the pusher plate 91. This preset stall force substantially exceeds the force required for the pusher plate 91 to advance the meat piece M along the trough toward and positively against an opposed backstop plate 126 (FIG. 2A) of the slice weight control unit 18. The forward and reverse speeds of the motor 97 and the pitch of the lead screw 102 may be selected to provide advancement and retraction speeds of the pusher plate 91 at a desired rate.

While use of an electrically driven motor 97 is contemplated, in the disclosed embodiment the motor 97 is a pressure fluid driven motor in which controlled pressure at the fluid inlets (for forward and reverse rotation) provides the desired advance and retract speeds and stall torque. An example of such a fluid motor is the Model TACH 125, manufactured by Tachyon, Inc., located at Minneapolis, Minn.

It is also contemplated that, for example in case of an electric motor 97, the coupling 99 may include a slip clutch slip adjustable to preset the desired stall torque.

The meat feeding unit 16 further includes a meat clamp assembly 131 actuable for securely holding the piece of meat M positively at the longitudinal position determined by its abutment against the backstop 126, and at least while the trough 51 carries the piece of meat M rearwardly past the blade 36A for cutting a slice therefrom. In the embodiment shown, the clamp assembly 131 comprises a pivot shaft 133 (FIGS. 5A and 7) extending parallel to and about the height of the front wall 95 of trough 51 near the output end thereof. The ends of the shaft 133 are fixedly carried by brackets 134 fixed to and upstanding from the table 72 in front (as "front" is defined in FIG. 2) of the slide bar 96. A pivot frame 136 is generally L-shaped as seen in FIG. 5A with base legs 137 pivoted on and upstanding from the pivot shaft 133 and at their upper ends fixedly carrying normally horizontal clamp support legs 138 (FIGS. 4, 5A and 7), a cross piece 139 connecting the upper ends of the base legs 137 rigidly together. The horizontal legs 138 here each support three upstanding meat clamping pressure fluid cylinders 141 preferably spaced symmetrically across the width of the trough and with the center pressure fluid cylinder having a longer stroke, such that the lower ends of the piston rods of the pressure fluid cylinders, can be extended nearly down to the portion of the trough therebelow, yet while partly retracted can clamp a large diameter piece of meat M in the trough. The lower ends 142 of the piston rods are preferably provided with noncontaminating, easily cleaned plastic feet, or cups, 142. The horizontal leg 138 nearest the saw blade 36A carries a slightly tilted shelf 146 (FIGS. 4 and 7) in turn carrying a further triplet of clamping pressure fluid cylinders 141 upstanding therefrom, the piston rods which carry the meat engaging, cuplike feet 147 at a location very close to the plane of the saw blade 36A and adjacent end of the trough 51, by means of a parallelogram linkage 148, the lower arm of which is pivoted to supports 149 fixedly depending from the inner edge of the shelf 147. With the meat clamp assembly 131 pivoted to its operative position shown in FIGS. 5 and 7, extension of the piston rods of the cylinders 141 engages their feet 142 and 147 firmly with the piece of meat M in the trough 51 to fix same to the trough as a slice is removed from the free end of the meat piece by saw 36A.

While it is contemplated that the cylinders 141 may be single-acting spring retracted cylinders, in the embodiment shown, double-acting cylinders are employed. Conveniently, the pressure fluid lines for all of the cylinders 141 can be led through a common manifold 158 fixed on the cross member 139.

To facilitate loading of a piece of meat M into the trough 51, the L-shaped pivot frame 136 is pivotable clockwise from its FIG. 5 to its FIG. 5A position to raise the feet 142 and 147 of the pressure fluid cylinders up and somewhat sidewardly of the trough. To accomplish the swinging, a swing pressure fluid cylinder 152 is connected at its bottom through a pivot 153 (FIGS. 5A and 7) fixed at the front edge of upper table 72 and has an upward extending piston rod pivotally connected at 154 to a forwardly offset screw 156 on one of the upstanding legs 137, such that retraction of the pressure fluid cylinder 152 causes such clockwise pivoting of the meat clamping cylinders 141 and L-shaped pivot frame 136 away from the trough 51 to facilitate loading a meat piece M from the rear (see FIG. 2) side of the machine. It is contemplated that the frame 136 can instead be constructed in mirror image for pivoting counterclockwise from the rear side of upper table 72, if meat M is to be loaded at the front of the machine.

The slice weight control unit 18 comprises a backstop assembly 170 (FIGS. 1, 2 and 10), a scale device 172, comprising a weight responsive load cell 177 for producing a voltage signal proportional to the weight of a meat slice $S_2$ thereon, and a feedback control circuit 174 responsive to deviations in the weight of the slice $S_2$ from a preselected slice weight for causing the backstop assembly 170 to move its backstop plate 126 in a direction toward or away from the adjacent end of the trough 51 to tend to reduce the extent to which the next cut meat slice deviates from the desired weight.

In the embodiment shown in FIGS. 2 and 10, the scale 172 includes a horizontal platform 176 to the rear of and somewhat overlapped by the output end of the trough 51 for receiving a slice S2 parted by the saw blade 36A from the piece of meat M as the latter is moved rearward with the trough 51 along the guide bars 71L and 71R over the scale platform 176. The weight of the slice is applied to the load cell 177 (FIG. 10) to produce a weight proportional voltage signal W on a line 178. The feedback control circuit 174 here includes an operator-selected reference weight signal source 182 (e.g. a potentiometer connected across a fixed voltage source in a conventional manner) connected to opposite polarity terminals of a pair of conventional differential amplifiers 183 and 184 operating as comparators, wherein the remaining opposite polarity input terminals of the operational amplifiers 183 and 184 are fed by the sensed weight signal line 178, such that one of comparators 183 and 184 outputs when the sensed weight signal exceeds the reference weight signal and the other outputs when the sensed weight signal is less than the reference weight signal. The comparators may be set up so that when the sensed and reference weight signals are almost, though not precisely equal, neither comparator outputs. In the embodiment shown, an output from comparator 183 or 184 acts through a respective relay 186 or 187 to advance a conventional stepping motor 189 a step in the forward or reverse direction, depending on which of comparators 183 and 184 outputs.

The step motor 189 may be of any conventional kind. One kind of step motor device 189A providing a forward-reverse rotative stepping output to a shaft 191A comprises a circumferentially toothed disk 192, whose shaft 191A is supported for rotation on a suitable fixed support or housing member 193 with respect to which are fixed a pair of solenoids 196 and 197 on opposite sides of the disk 192. The solenoids 196 and 197 each have a resiliently extended, electrically retracted rod 198. An end hook 199 of each rod 198 is normally located out of interfering relation with the teeth on the disk 192, but upon electrical actuation of the corresponding solenoid 196 or 197, the rod 198 thereof retracts, bringing the hooked end 199 into engagement with a tooth of the wheel 192 to bring same down therewith and thereby rotate the disk 192 through a rotational step. The hooked end 199 can resiliently bend in toward the carrying rod 198 so as to not move the disk 192 when electrical energization stops and the piston rod 198 extends back to its normal rest position shown. A conventional resilient detent 195 permits disk rotation by a retracting rod 198 but blocks unintended rotation.

If the stepping motor 189 is of a type requiring a pulsed input, same may be provided as shown in FIG. 10 by inserting AND gates 201 and 202 between the respective comparators 183 and 184 and relays 186 and 187, the AND gates 201 and 202 being gated on by a conventional one-shot multi-vibrator pulse source 203 providing the desired pulse duration at a desired point in the cycle of operation of the machine 10, for example upon actuation of the limit sensor 84R (FIG. 2) by movement of the trough 51 into its orbit's rear-output corner, upon completion of cutting of a slice by the blade 36A and laying same on the scale plate 176.

If it be desired to manually step the motor 189, same can be done by interposing between the comparators 183,184 and relays 186,187 a respective pair of OR gates 205 and 206 for operating the corresponding relay 186 or 187 in response to closure of a corresponding manual switch 207 or 208.

Suitable power and/or buffer amplifiers may be inserted as needed in a conventional manner in the control circuit 174 to allow the weight and reference signals to drive the motor 189.

The step motor 189 has been described above as an electric step motor. However, a similar reversible rotate step motor of fluid driven kind can be used instead, for example by substituting for the relays 186 and 187, corresponding solenoid valves for connecting forward and reverse inputs of the step motor to a pressure fluid source, such as pressurized air. Pressure fluid rotate step motors of any desired kind may be used, and indeed even the type device shown in FIG. 10A can be made pressure fluid driven if spring extended, pressure fluid retracted cylinders are substituted for the solenoids 196 and 197.

Figure 9:
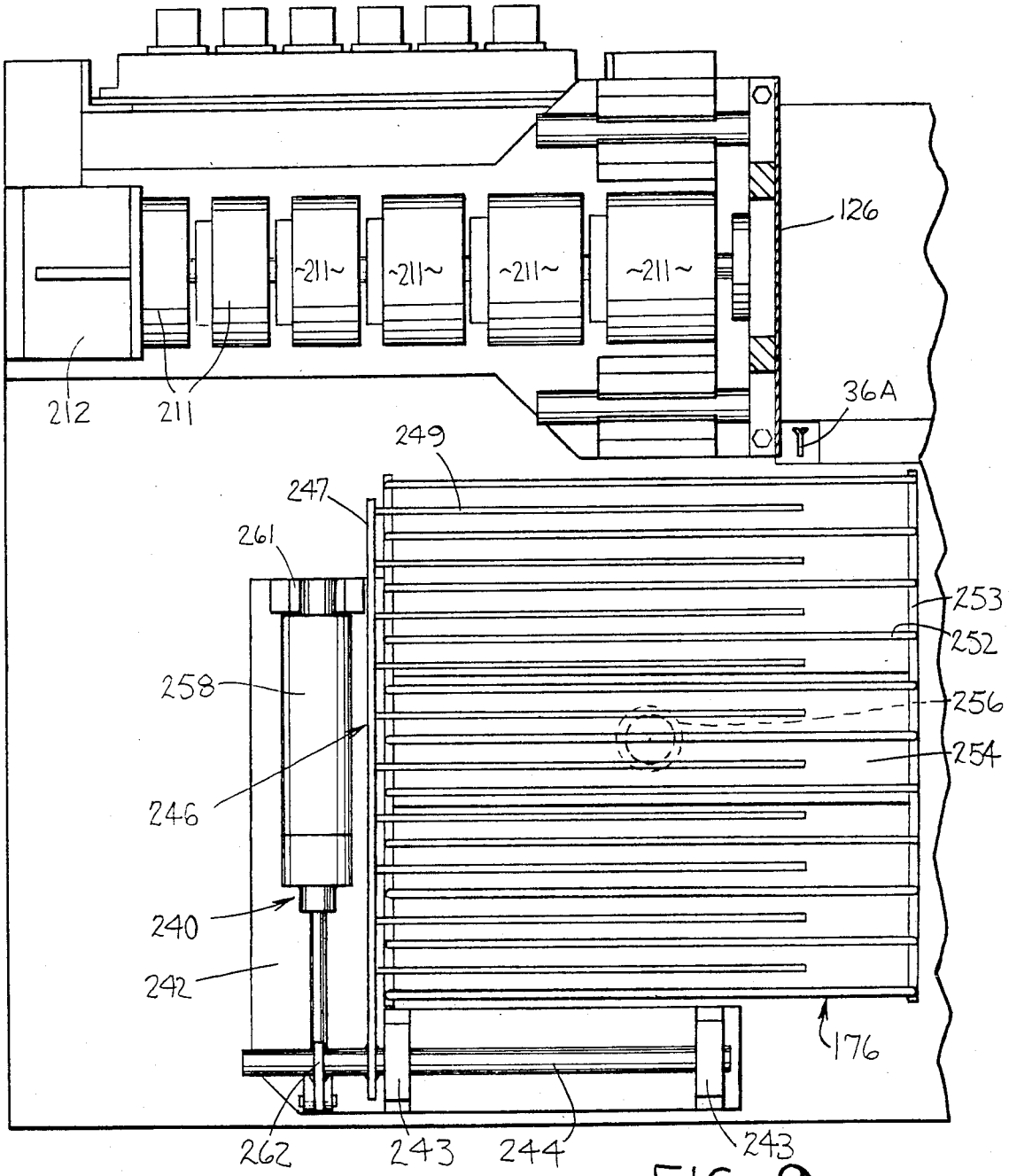
FIG. 9 is an enlargement of the leftward end portion of FIG. 2 with the cover of the backstop assembly removed to show details thereof and further showing details of the scale and meat unloader.

It will be understood that the particular circuit 174 above discussed is shown here for purposes of example, and that other conventional circuitry may be substituted. It is contemplated, for example, that the relays 186 and 187 may be preceded by serial output analog to digital (A/D) converters (not shown) for producing a number of stepping pulses proportional to the difference between sensed and reference weight signals W and R (with proportional output differential amplifiers used at 183 and 184) to step the motor 189 once or more than once per slice and thus vary the back stop adjustment distance. It is also contemplated that a suitably programmed computer may be substituted for circuit 174 and respond to digital-type sensed weight and reference signals to forwardly and reverse step the motor 189 shown in FIG. 10 to leftwardly or rightwardly stepwise adjust the backstop plate 126, or to step the backstop plate 126 by means other than a rotate motor, e.g. by linear motor means. The upper portion of FIG. 9, for example, shows a linear motor system of one specialized kind, namely formed of a serially arranged set of pancake cylinders 211 of varying short strokes actuable in different combinations to set the backstop plate 126 at various distances from the saw blade 36A. The pancake cylinder 211 most remote from the backstop plate 126 is backed by a fixed abutment 212.

Returning to FIG. 10, the step motor 189 is here fixed on a carriage 216 slidably guided at 217 in a direction perpendicular to the plate 126, on a base 219 in turn fixed on the top of the cabinet 31. A screw 221 is adjustable, here manually adjustable, to locate the step motor 189 and thereby the backstop plate 126 at a desired initial position with respect to the plane of the blade 36A. In addition, the shaft 191 of the step motor 189 is connected to the backstop plate 126 in a manner to move the backstop plate to the right or left in response to forward and reverse rotation of the step motor. In the embodiment shown, this is accomplished by fixing a nut 223 in spaced but fixed relation to the back of the backstop plate 126, and threadedly engaging therein a screw 224 fixed to the shaft 191 by a coupling 225 for rotation thereby. Slide guides 227 upstanding from the carriage 216 receive slidably therethrough support pins 228 fixed to the left face of the plate 126. The position of the plate 126 with respect to the saw blade 36A (and hence the slice thickness) can be monitored in any desired way, electronically or otherwise. In the embodiment shown, a pointer 230 fixed to the free end of one of the pins 228 is superimposed over and movable with respect to graduations 231 distributed along the base 219, but use of a conventional electric position sensor and display (not shown) is also contemplated.

If desired, the slice weight output W of the load cell 177 may be applied through a branch of lines 178 to a conventional analog or digital display 231 preferably conveniently readable by the system operator.

If desired in FIG. 10, the slide guides 217 and adjustment screw 221 can be eliminated and the carriage 216 fixedly mounted on a cabinet 31 so that even initial slice thickness selection (spacing of backstop plate 126 from blade 36A) is handled by stepping the motor 189, for example as above described with respect to switches 207 and 208.

Preferably, a scale unloader 240 (FIGS. 1, 2 and 2A) is provided for removing a slice $S_1$ from the scale platform 176 and onto the output conveyor 22 prior to cutting and arrival of a new slice $S_2$ on the scale. The particular unloader 240 (FIGS. 8 and 9) here shown comprises a base 242, L-shaped in plan, having upstanding bosses 243 adjacent the conveyor 22 pivotally mounting a horizontal shaft 244. A lifter 246 comprises a lever 247 fixed at one end to the shaft 244 (extending forward as seen in solid lines in FIGS. 8 and 9) alongside the scale platform 176 and from which are fixedly cantilevered in rightwardly (FIG. 9) extending relation a plurality of rodlike fingers 249. In the embodiment shown, the platform 176 comprises a plurality of side-by-side spaced, inverted U-shaped rods 252 upstanding at their ends from a pair of forwardly extending, on-edge bars 253 in turn fixed upon a cross plate 254 centrally fixed on the upper end of the scale column 256. Thus, in the lowered position of the lifter 246, its fingers 249 lie below the level of the slice supporting rods 252 of the scale platform 176, so as not to interfere with weighing of the slice.

On the other hand, by pivoting the lifter 246 up from its solid line horizontal position of FIG. 8 to its overcenter pivoted dotted line position, a slice can be lifted from the scale platform 176 and dropped on the conveyor 22 for removal. This pivoting may be accomplished by a pressure fluid cylinder 258 pivoted at its front end on an upstanding boss 261 on base 242 and extending rearward (rightward in FIG. 8) to pivotally engage with its piston rod a bell crank 262 fixed to shaft 244 to rotate same.

OPERATION

Figure 12:
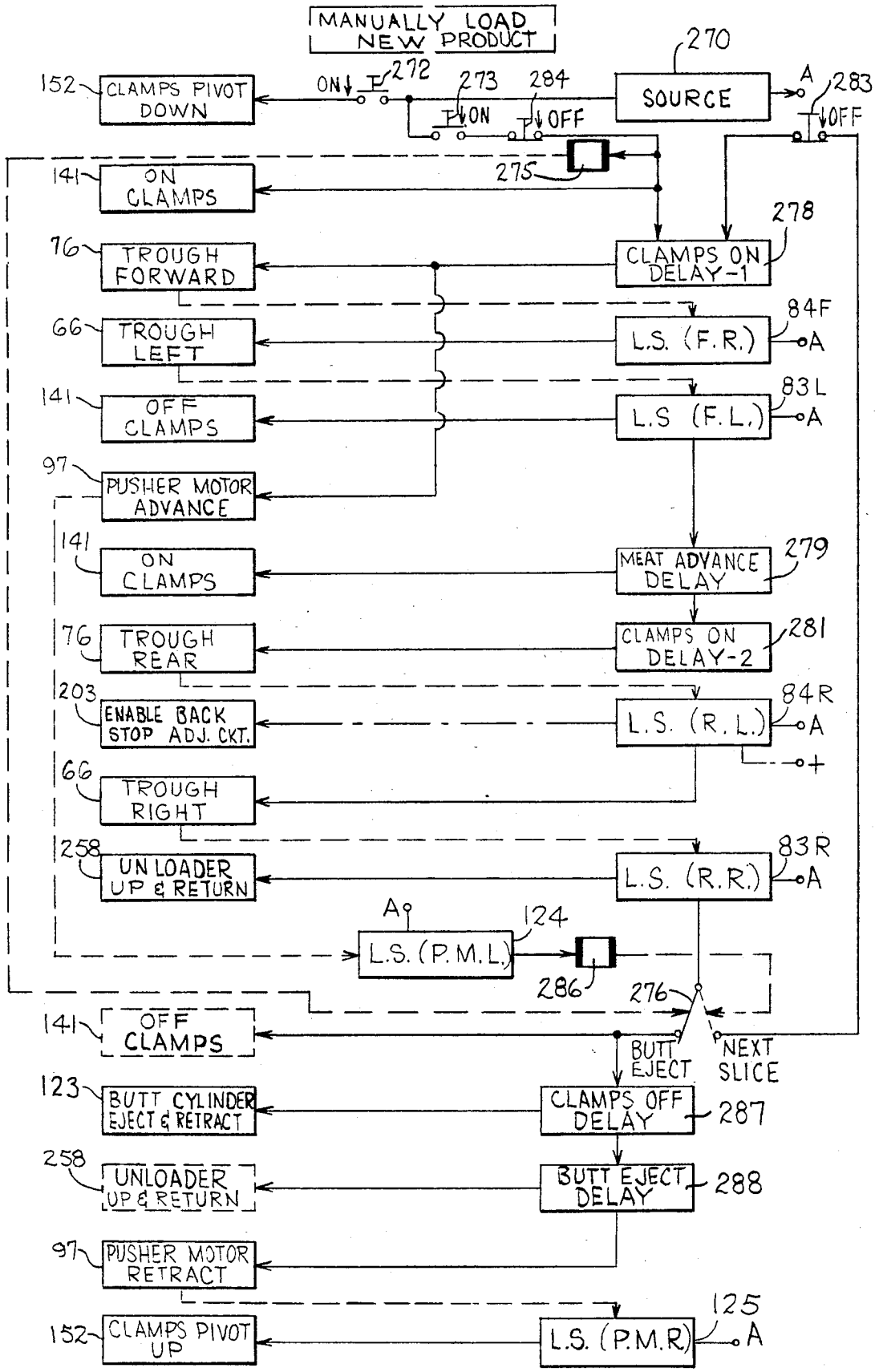
FIG. 12 is a diagrammatic view of an automatic control useable with the FIGS. 1–11 machine, showing a preferred sequence of operation.

The above-described rotary pusher motor 97 and cylinders 66, 76, 141, 152, 123 and 258, and the backstop adjustment circuit enabling one-shot 203 (hereafter generally referred to as powered actuators) can be operated by a variety of means, either manually or under control of the above-discussed limit sensors 83L and R, 84F and R, 124 and 125, to achieve any desired one of several possible operating sequences. FIG. 12 discloses diagrammatically one preferred arrangement, showing in a general manner the operative connection from such limit sensors to such powered actuators and the sequence in which such powered actuators are operated. To more clearly illustrate the sequence of their operation, FIG. 12 shows several of the powered actuators more than once. For example, in the left column of FIG. 12, the trough cylinder 66 appears twice, first at the fourth level where it is actuated by the front right limit sensor 84F to move the trough toward the plane of the blade 36A (leftward in FIG. 2), and the same cylinder 66 appears at the tenth level where is actuated by the left limit sensor 84R to move the trough away from the plane of the saw blade 36A (rightwardly in FIG. 2).

In the particular embodiment shown in FIG. 12, the limit sensors are shown as limit valves controlling flow of compressed air from a conventional compressed air source 270. The solid line connection between blocks denotes compressed air lines, the broken lines denote mechanical connections and the chain line denotes an electrical connection. As to the latter, the rear left limit sensor 84R will be understood to include both electric limit switch and air limit valve portions.

The sequence of operation shown in FIG. 12 provides for loading of a new product (for example a loin or other meat piece M) in the trough 51 when the latter is in the right rear (as these terms are used in FIG. 2) corner of its orbit, to which corner the trough 51 is returned after completion of slicing of the meat piece M and for ejection of the remaining butt portion of the meat piece, which is not to be sliced, such that the right rear corner of the orbit can be considered the rest position of the trough in the particular operation sequence shown in FIG. 12.

Although the operation of the components of the machine shown in FIGS. 1-11 has been discussed in detail above, same is briefly summarized below in connection with FIG. 12. To initiate operation of the machine 10, a new meat piece M may be loaded into the empty trough 51, with the latter assumed to be in its FIG. 12 rest position at the right rear (FIG. 2) corner of its orbit. Electric operating potential, from a conventional source not shown, is applied to the FIG. 10 backstop adjustment circuitry and suitable electric operating potential (such as 110 volts AC line current) is applied to the saw 20 to operate same. Also actuated is the compressed air source 270 (which may be a conventional compressor, filter and air tank unit) locatable within the subframe 12. As above noted, if the FIG. 10 backstop step motor 189 is to be air rather than electrically operated, electrically operated air valves controlling air pressure from the source 270 (FIG. 12) would be substituted for the relays 186 and 187 of FIG. 10.

After the foregoing initial steps, slicing of the meat piece M can be initiated in FIG. 12 by actuation "on" manual valve 272 to cause cylinder 152 to pivot the clamps down toward the meat piece, from their FIG. 5A to FIG. 5 position. Thereafter, actuation of a further manual "on" valve 273 causes source 270 to cause clamp cylinders 141 to clamp the meat firmly to the trough, and to cause source 270 to act through an air-to-mechanical transducer 275 of conventional type to swing a two-position valve 276 to its dotted line, "next slice" position, and to apply air pressure to a conventional delay device 278. The delay device 278 provides a delay sufficient to allow the clamp cylinders 141 to clamp the meat piece to the trough 51 and then passes air from the source 270 to trough cylinder 76 to cause the latter to move the trough 51 to the right front corner of its orbit (as defined in FIG. 2), and to pusher motor 97 to cause same to advance the pusher assembly 90 toward and firmly against the trailing end of the meat piece M, the latter remaining fixed in place on the trough by the "on" (extended) condition of the clamp cylinders 141. When the forward moving trough 76 reaches the front right corner of its rectangular orbit, it actuates the front right limit sensor 84F which applies compressed air from source 270 to the trough cylinder 66 to move the trough leftwardly in FIG. 2 to its position adjacent the plane of the leg 36A. When the trough 51 thus reaches the front left corner of its rectangular orbit, it actuates the front left limit sensor 83L which applies compressed air to retract ("turn off") the clamp cylinders 141 which allows the pusher motor to push the meat piece into engagement with the backstop plate 126.

Simultaneously, such front left limit sensor 83L initiates timing by a further conventional air delay device 279 which times a delay sufficient to allow the meat to advance into contact with the backstop plate and then applies compressed air to extend ("turn on") the clamp cylinders 141 to once again clamp the meat piece M firmly to the trough 51. Simultaneously, the delay device 279 starts a further conventional delay device 281 timing. When the device 281 times out after allowing sufficient time for the clamps to fix the meat piece to the trough, it actuates the trough cylinder 76 to move the trough rearwardly along the plane of the blade 36A on the cutting leg of the rectangular trough orbit, thereby cutting a slice from the meat piece M and allowing same to fall upon the scale platform 176 as the trough 51 continues its rearward cutting movement. When the trough 51 reaches the end of its cutting stroke, it actuates rear left limit sensor 84R, causing the corresponding electrical contact indicated at 84R in FIG. 10 to actuate the one-shot 203 and enable the gates 201 and 202, to permit adjustment of the position of the backstop plate 126 by the motor 189 to reduce any difference between the slice weight and reference weight signals on lines W and R. Simultaneously, the limit valve portion of the limit sensor 84R (FIG. 12) applies compressed air to the trough cylinder 66 to move the trough away from the plane of the blade 36A (rightward in FIG. 2) until the latter actuates limit sensor 83R. Actuation of the limit sensor 83R momentarily actuates the scale unloader cylinder 258 (FIG. 8) to remove the weighed slice from the scale and place it on the upward conveyor 22. Simultaneously, the actuated limit sensor 83R applies compressed air to the two-position valve 276.

With the two-position valve 276 in its rightward "next slice" position as above discussed, such air pressure is applied through a normally closed, manually openable shutoff valve 283 to above-mentioned first "clamps on" delay unit 278 to start another slice cycle like that above described.

The FIG. 12 arrangement will thus continue to cycle the machine 10 through a series of slice cycles, in each of which a slice is cut from the meat piece, the FIG. 10 backstop adjustment apparatus appropriately adjusting the position of the backstop plate 126 so as to maintain substantially constant slice weight. The human operator can manually shut off the valve 283 at any time to prevent the start of the next slice cycle.

It will be understood that in each slice cycle the pusher motor 97 advances the pusher plate 91 further toward the backstop plate 126 to again abut the meat piece thereagainst. Eventually the pusher plate carriage 106 advances far enough leftwardly in FIG. 2 to actuate the "pusher motor left" limit sensor 124 which, as seen in FIG. 12, acts through a conventional air-mechanical transducer 286 to shift the two-position valve 276 to its leftward "butt eject" position and breaks the connection from the right rear limit sensor 83R back through the "next slice" line to the first "clamps on" delay device 278. Thus, the FIG. 12 apparatus can continue the existing slice cycle but a further slice cycle is precluded. More particularly, following such actuation of the "pusher motor left" limit sensor 124, the existing slice cycle completes with clamping of the meat to the trough, forward movement of the trough to cut a last slice from the meat piece M, enabling of the backstop adjustment circuit, shifting of the trough to its right rear orbit corner, an open return cycle of the slice unloader and application of air pressure by the right rear limit sensor 83R to the leftward "butt eject" outlet of two-way valve 276, to institute a "butt eject" cycle.

In FIG. 12, such butt eject cycle begins with valve 276 applying air pressure to the clamping cylinders 141 to retract same and to a further conventional air delay device 287, the "clamps off" delay. After timing out a sufficient time to allow the clamp cylinders 141 to retract and free the meat piece butt, the delay device 287 applies air pressure momentarily to the butt cylinder 123 to eject the residual butt portion of the meat piece M from the leftward (FIG. 2) end of the trough. The trough orbit is preferably narrow enough from left to right that the ejected butt falls from the trough onto the scale-unloader unit 240.

Since the trough is in its right rear orbit corner, the rear left limit sensor 84R is not actuated and the one-shot 203 of the backstop adjustment circuit is not enabled and so no change is made in the position of the backstop plate 126 by the weight of the butt portion on the scale platform 176. However, the unloader 240 (including unloader cylinder 258) is available to flip the butt portion onto the output conveyor 22 for subsequent handling.

To achieve this, such timing out of delay 287 also actuates a further conventional air delay 288 (the butt eject delay) which times an interval sufficient to ensure shifting of the butt from the trough onto the unloader 240. Timing out of the butt eject delay 288 then causes the unloader cylinder 258 to flip the butt from the scale onto the output conveyor 22.

Timing out of butt eject delay 288 also actuates the pusher motor 97 to retract the pusher carriage 106.

Retraction of the pusher motor carriage 106 immediately releases the pusher motor left limit sensor 124 which simply leaves the valve 276 in its present butt eject position such that the clamps off delay unit 287 and butt eject delay unit 288 continue to supply compressed air at the outputs thereof. This enables the pusher motor 97 to continue its retracting of the carriage 106 away from the plane of the cutting blade 36A and backstop plate 126. However, the butt cylinder 123 and unloader cylinder 258 in FIG. 12 are arranged to respond to application of compressed air by executing their respective eject and up (respective trough unloading and scale unloading) movement, and then immediately returning to automatically complete their full operative cycle, despite continued presence of air pressure applied from the clamps off delay 287 and applied from the right rear limit sensor 83R at the end of a normal slice cycle or from the butt eject delay 288 in the butt eject cycle. The butt cylinder 123 and unloader cylinder 258 are preferably interactuated, spring retracted (returned) single-acting cylinders.

The pusher motor 97 continues to retract the pusher carriage 106 until the latter engages the pusher motor right limit sensor 125, and reaches the end of its retract travel. The thus-actuated limit sensor 125 in turn actuates the pivot cylinder 125 to pivot the clamp assembly 131 upward out of the way to its FIG. 5A position. This places the apparatus in position for manual loading of a new meat piece M and a repetition of the multiple slice and butt eject cycle above described.

Each of the two-way (double acting) operated devices 152, 141, 76, 66 and 97 in the left column of FIG. 12 can be operated for advance and return motions through a corresponding, conventional, air piloted, reversing valve operated by the corresponding one or ones of the air supply devices to the right thereof in FIG. 12. It is believed one example will suffice for all.

Figure 13:
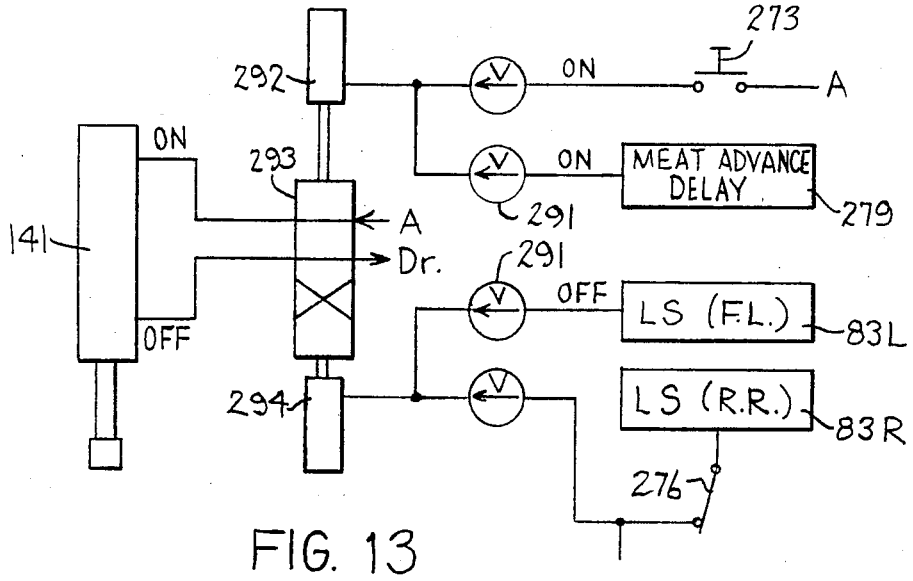
FIG. 13 is a schematic view showing an example of control of one of the double-acting air power devices of the machine 10 by associated control devices.

FIG. 13 shows such an example for the clamp cylinders 141 which in accord with FIG. 12 are extendible by the actuation of the manual "on" valve 273 at one time and at another time by the meat advance delay 279, and are retracted at one time by the front left limit sensor 83L and at another time by the right rear limit sensor 83R acting through the two-way valve 276 in its leftward, butt eject, position. The first two mentioned of these air supply sources connect through respective one-way valves to an upper pilot 292 which when actuated thereby places the reversing valve spool 293 in its downward, straight flow position shown to connect the clamp cylinders 141 to the pressurized air output A of the air source 270 and to drain (e.g. the atmosphere) in such manner as to extend the piston rods of the clamping cylinders 141. Alternately, when either of the last-mentioned two air supply devices 83L and 83R (through valve 276) is actuated, it supplies air through a corresponding one of the one-way valves 291 to the lower pilot 294 to shift the reversing valve spool upward from its position shown to its reversing position wherein the connection of the air source line A and drain to the clamping cylinders 141 is reversed to retract the piston rods of the clamping cylinders 141.

Corresponding similar reversing valve assemblies 292–294 (not shown) may similarly be provided for each of the two-way air driven devices 152, 76, 66 and 97. The one-way valve 291 can be omitted when a given pilot 292 or 294 can receive compressed air from only a single source.

Figure 14:
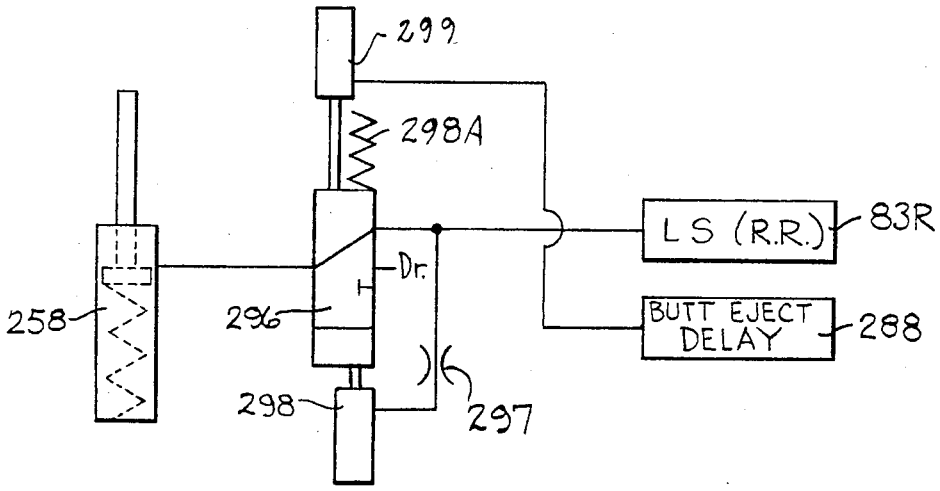
FIG. 14 is a schematic view showing control of one of the single-acting pneumatically powered devices of the machine 10 by several control devices.

On the other hand, the one-way (single acting) cylinders 123 and 258 can be supplied a short duration pulse of air so as to proceed quickly through their entire forward and reverse (retract extend or extend-retract) cycle. Turning on of air pressure from the corresponding air supply device 83R, 288 or 287 can provide such an air pulse by means of a kind of pneumatic "one-shot" device. An example is shown in FIG. 14 with respect to the unloader cylinder 258. In such one-shot device, a valve spool 296 is normally spring biased at 298A to its lower position shown in which the air supply device 83R can supply compressed air to the single air inlet of the single-acting cylinder 258 to overcome the usual return spring therein. Shortly thereafter, a flow restrictor 297 permits sufficient air pressure from the same supply device 83R to reach the lower pilot 298 and actuate same. That drives the valve spool 296 upward against its spring 298A and connects the single air port of the cylinder 258 to drain (e.g. atmospheric air) and blocks further air supply to the cylinder 258 from device 83R. Thus connected to drain, the piston of cylinder 258 is returned to its original position shown, completing one unloader cycle with the unloader tray returned to its down (horizontal) position ready to receive another slice or the butt. In a normal slice cycle, the limit sensor 83R thereafter soon is deactuated by continuation of trough movement through its cycle and its output line goes low in pressure, allowing spool 296 to spring return to its FIG. 14 position with the spring of cylinder 258 still holding the piston rod thereof in the FIG. 13 position ready for a new unloader cycle.

However, in a butt eject cycle, the trough rests in its right rear position and holds limit sensor 83R actuated and the latter thus does not permit return of the valve spool 296 to its original position. This would interfere with a further cycling of spool 296 and cylinder 258 by the butt eject delay 288. This problem can be overcome as shown in FIG. 14 where an added upper pilot 299 is actuated by the butt eject delay 288 and assisted by the spool spring, overcomes the actuated lower pilot 298 to drive spool 296 down to its position shown, allowing the still "high" air pressure from limit sensor 83R to retract cylinder 258 and unload the butt onto conveyor 22. In this arrangement, the lifter 246 of unloader 240 thus remains up (dotted line position in FIG. 8) until a new meat piece has been loaded and a new meat slice operation is started by actuation of start valve 273 and timing out of delay 278 to shift the trough forward and release the right rear limit sensor 83R.

The FIGS. 12–14 control arrangement has been described above in terms of pneumatic circuitry but can be implemented instead with electrical circuitry. To do so, the source 270 can be a voltage (e.g. DC) source, with electric switches at 272, 273, 276, 283 and 284, solenoids at 275 and 276, electric (for example RC) time delays at 278, 279, 281, 287 and 288, and electric limit switches at 84F, 83L, 84R, 83R, 124 and 125. With limit sensor 84R as an electric limit switch, the same contacts can be used to actuate both outputs of such limit sensor 84R in FIG. 12. Further, the pilots 292, 294, 298 and 299 can be solenoids and the one-way valves 291 can be diodes, with compressed air and drain connections still being made to ports A and Dr in FIGS. 13 and 14. Also in FIG. 14, the fluid restriction 297 would be changed to a suitable electrical delay (e.g. RC delay).

As an alternative, it may be desired to load the meat piece M from the front (FIG. 2) of the machine 10, rather than from the rear as discussed above. In that instance, FIG. 12 may be modified so that, at the end of each slice cycle and at the end of a butt eject cycle, it allows the trough to proceed forward to its right front corner before stopping at slice cycle end or butt eject cycle end. To do this, FIG. 12 can be simply modified by deleting the connection between the number 1 clamps on delay 278 and the trough forward block 76 and instead having the rightward limit sensor 83R actuate the trough forward block 76 simultaneously with its actuation of the unloader up and return block 258.

As a further alternative, it is also contemplated that the fluid actuated devices in the left column of FIG. 12 can be sequenced by a programmed computer or microprocessor either on a strictly timed basis, or preferably in response to control by the limit sensors shown in the mid and right portions of FIG. 12, for example with the various delays being timed by the programmed microprocessor. In that alternative, the microprocessor may control the running of the saw, application of electric power to the compressed air source 270, etc., as well as controlling adjustment of the backstop plate 126 in substitution for the hard wired circuit 174 of FIG. 10.

For convenience, it is preferred that all controls and displays above described with respect to the machine 10 be centralized, for example on a control box assembly 300 located for convenient visibility and access by the machine operator, for example as in FIG. 1.

The air supply circuit for the machine 10 is preferably arranged such that with the machine shut off, all air actuated devices can be manually moved back and forth through their normal operating path, for example in FIG. 12 by venting the lines from the pneumatic source 270 and/or providing venting ports and lines to the various cylinders and rotatable air motors as needed.

Figure 16:
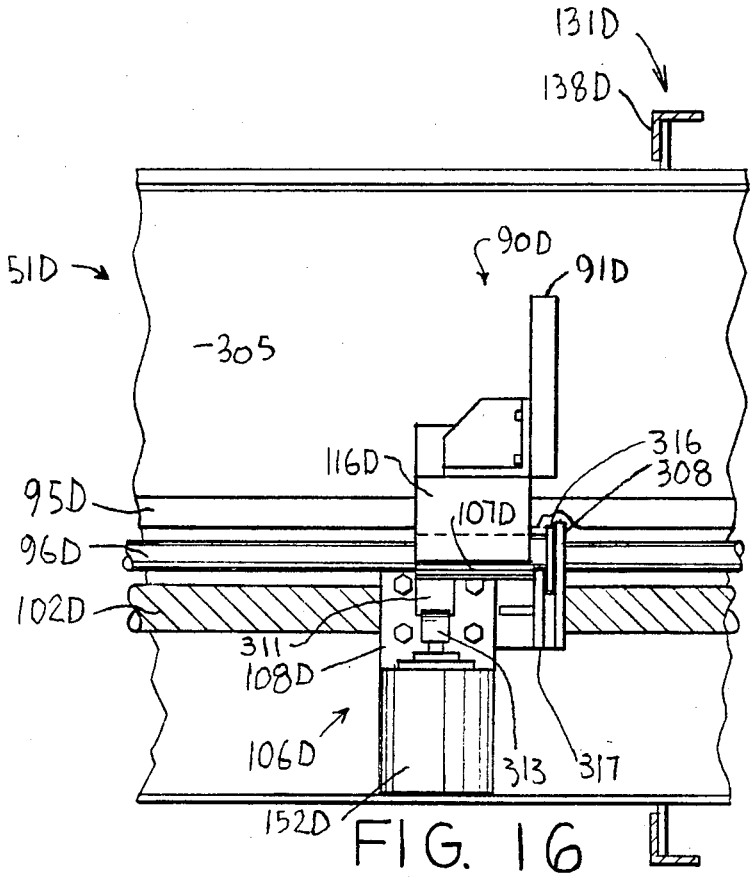
FIG. 16 is a fragmentary top view of the FIG. 15 modified structure.
Figure 15:
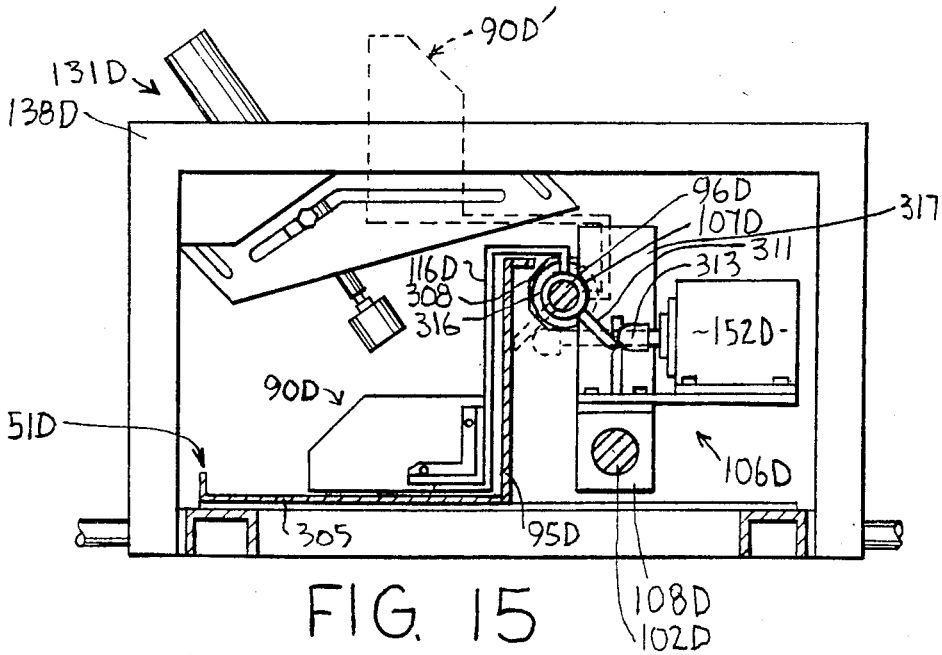
FIG. 15 is a view similar to FIG. 5A but showing the upstream end of a modified trough, pusher assembly and clamp assembly.

FIGS. 15 and 16 disclose a modified trough 51D, pusher assembly 90D and meat clamp assembly 131D, which as described below differ from the units 51, 90 and 131 above-described with respect to FIGS. 1–14. Corresponding parts are indicated by the same reference numeral with the suffix "D" added. In FIG. 15 the trough 51D is oriented with its left (rear) wall 305 horizontal and its right (front) wall 95D vertically upstanding therefrom. Instead of extending through a slot in the front wall 95D (no such slot being provided), the bracket 116D is generally of inverted U-shape, and extends fixedly upward from the upper carriage portion 107D (which slides on guide rod 96D), then leftwardly loosely over the top of front trough wall 95D, then down loosely along the left or inside surface thereof to support the pusher plate 91D. In FIG. 15 there is no pusher cylinder as at 123 in FIG. 5A and the pusher plate 91D is, as a result, rigidly fixed to the bottom of the left leg of bracket 116D. The lower portion 108D of the carriage 106D, which rides on and is advanced and retracted by the screw 102D, is prevented from rotating with respect to the trough 51D by any convenient means as the screw 102D rotates. For example, the lower carriage portion 108D here shown has fixed to the downstream end thereof a radial plate extension 308 snugly slidable along the guide rod 96D as the screw 102D advances and retracts the carriage 106D.

Figure 4:
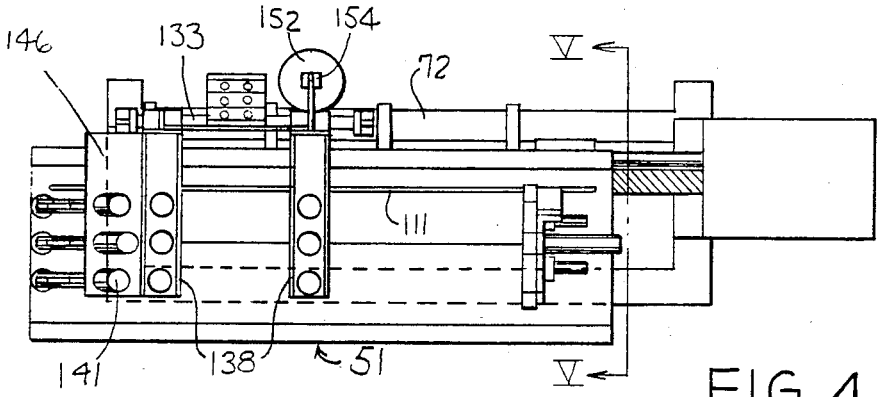
FIG. 4 is a top view of the rightward portion of the FIG. 1 machine showing the meat trough and the meat clamp assembly.

In FIGS. 15 and 16, the meat clamp assembly 131D omits the pivot frame 136 and pivot cylinder 152 seen in FIGS. 5 and 5A but instead utilizes a generally inverted U-shaped fixed frame 138D loosely overlying the downstream end portion of the trough 51D, guide rod 96D and screw 102D, and hence near the point of the saw blade, a location similar to that of the meat clamp assembly frame 138 in FIG. 4.

To facilitate insertion of a new meat piece, instead of pivoting the clamping frame upward as in the FIGS. 1–14 embodiment, the FIGS. 15 and 16 modification instead pivots upward the pusher assembly 90D about the guide rod 96D substantially to its dotted line position 90D' (in FIG. 15) after such pusher assembly 90D has been retracted far enough from the plane of the blade to clear the fixed meat clamp assembly 131D. To this end, the upper carriage portion 107D has a fixedly angled (downward in FIGS. 15 and 16) leg 311. A pressure fluid cylinder 152D is fixed atop the lower carriage portion 108D and its piston rod 313 bears on the lower end portion of leg 311 and is extensible to rotate the upper carriage portion 107D and attached pusher assembly 90D clockwise to dotted line position 90D', the pressure fluid cylinder 152D being deactuable to permit its piston rod 313 to retract and the pusher assembly 90D, by its own weight, to pivot counterclockwise to its solid line position shown.

Although the upper carriage portion 107D is thus pivotable with respect to the lower carriage portion 108D, nevertheless carriage portions 107D and 108D are connected to move axially together (and hence to move therewith the pusher assembly 90D) upon forward or reverse rotation of the screw 102D. To this end, in FIGS. 15 and 16, the upper carriage portion 107D is provided at its downstream end with a fixed annular flange 316, the circumferential edge portion of which is continuously and axially snugly received in a slot between the plate extension 308 and a radial flange 317 extending parallel to the plate extension 308 and fixed to the lower carriage portion 108D. Thus, carriage portions 107D and 108D must move axially together but carriage 107D is pivotable on guide rod 96D with respect to lower carriage portion 108D.

It has been found that the L-shaped trough 51D with its horizontal bottom wall 305 provides relatively low frictional retardation as to advancement of the meat piece and juices from the meat piece are less likely to escape rightwardly from the trough due to absence of a slot in the rightward trough wall 95D.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method for cutting slices from a sliceable product, comprising:

presetting a desired reference weight for a slice of said sliceable product;

advancing said sliceable product against an opposed adjustable backstop;

cutting said sliceable product in a plane spaced from said adjustable backstop to remove a slice therefrom; and adjusting the position of said backstop with respect to said cutting plane in a direction to tend to reduce a weight difference between the last cut slice weight and said preset reference weight in cutting the next slice from the sliceable product, said adjusting step including detecting the weight of the last cut slice, comparing said slice weight and reference weight and providing a difference output representing a difference therebetween, positioning said backstop by motor means, actuating said motor means in one direction to advance said backstop toward said cutting plane in response to a said difference output wherein said slice weight exceeds said reference weight, and actuating said motor means in the opposite direction to retract said backstop away from said cutting plane in response to a said difference output wherein said slice weight is less than said reference weight.

2. The method of claim 1 in which the first slice from the sliceable product is rejected.

3. The method of claim 1 including the further step of releasably clamping said sliceable product fixedly on a trough after said step of advancing said sliceable product against said backstop and prior to said cutting step, said cutting step including moving said trough and sliceable product past a cutting member, and including the further step, between said cutting step and the next advancing step, of returning said sliceable product and trough to their position opposed to said backstop and then releasing said clamping, to free said sliceable product for again being advanced against said backstop.

4. The method of claim 3 including the steps of:

supporting said trough for movement through a closed rectangular orbit near said cutting plane;

applying compressed air in a desired sequence to separate air motors for respectively moving (1) said trough through the sides of said rectangular orbit in cutting and return strokes, (2) said trough through the ends of said orbit, (3) said sliceable product against said backstop in said advancing step, (4) clamps, with respect to said sliceable product, in at least one of said clamping and release steps, (5) said backstop in said adjusting step, (6) a residual portion of said sliceable product off said trough in preparation for loading a new sliceable product, and for freeing said trough of at least one obstruction to ease loading of a new sliceable product therein.

5. The method of claim 1 including the further steps of supporting said sliceable product on a trough for movement with respect to a cutting member, repeating said steps of advancing, cutting and adjusting position through a number of cycles, and locating a sensor with respect to the cutting plane and therewith sensing when only a preselected length residual portion of said sliceable product remains unsliced and, upon said sensing, ejecting said residual portion from said trough, to make room for a new sliceable product to be sliced.

6. A method for cutting slices from a sliceable product, comprising:

presetting a desired reference weight for a slice of said sliceable product;

advancing said sliceable product against an opposed adjustable backstop;

cutting said sliceable product in a plane spaced from said adjustable backstop to remove a slice therefrom; and adjusting the position of said backstop with respect to said cutting plane in a direction to tend to reduce a weight difference between the last cut slice weight and said preset reference weight in cutting the next slice from the sliceable product, in which said adjusting step includes converting said slice weight and reference weight to representative signals, comparing said slice weight and reference weight signals to detect a difference therebetween, establishing the position of said backstop by a reversible motor, actuating said motor in one direction to advance said backstop toward said cutting plane in response to a said difference wherein said slice weight signal exceeds said reference weight signal, and actuating said motor in the opposite direction to retract said backstop away from said cutting plane in response to a said difference wherein said slice weight signal is less than said reference weight signal.

7. The method of claim 6 including prepositioning of said backstop with respect to said cutting plane, prior to cutting desired weight slices from said sliceable product, by manually controlled movement of said backstop independently of reference or measured slice weights.

8. The method of claim 6 including measuring the weight of the last cut slice by means of a weighing device positioned adjacent the cutting plane for receiving the slice after it is cut, said slice weight signal being obtained from said measured slice weight, said sliceable product being carried on a trough movable through a rectangular orbit with one side substantially parallel to said cutting plane and including the step of enabling said comparing of said signals in response to movement of said trough to a preselected plane in its rectangular orbit.

9. The method of claim 6 in which said motor is an electrical stepping motor and said signals are electrical signals.

10. A machine for cutting slices from a sliceable product comprising:

a cutting member lying in a cutting plane and having a cutting edge;

means for supporting said sliceable product on one side of said cutting plane;

a backstop member spaced on the other side of said cutting plane;

means for advancing said sliceable product to position one end against said backstop member to establish the thickness of a slice;

means for moving said sliceable product supporting means along said cutting plane to cut a slice from said one end of said sliceable product;

backstop control means for adjusting the spacing of said backstop member from said cutting plane, said backstop control means comprising (1) means manually actuable for presetting the initial spacing of said backstop member from said cutting plane and (2) means automatically actuable for shifting said backstop member from said initial position alternately closer to and further from said cutting plane, said automatically actuable means comprising (1) motor means operatively connected to said backstop member and having a travel range which is small compared to that of said sliceable product advancing means, and (2) slice weight monitoring means responsive to a difference between a preset reference weight and the weight of a cut slice and operatively connected to said motor means for shifting the backstop plate in a direction to reduce said difference, such that said motor means is capable of repetitive back-and-forth movement of said backstop plate during slicing of a single said sliceable product.

11. The machine of claim 10 including a fixed base, said sliceable product supporting means including a trough for supporting said sliceable product and in turn carried on a base for movement in a closed rectangular orbit with respect to said base, first and second pressure fluid cylinders interposed between said base and trough and arranged for moving said trough back and forth parallel to the cutting plane and for moving said trough toward and away from said cutting plane, respectively.

12. The machine of claim 11 including limit sensing means disposed along said closed rectangular orbit and actuable by movement of said trough through said orbit for sequentially actuating said first and second pressure fluid cylinders.

13. A machine for removing slices from a sliceable product comprising:

a cutting member lying in a cutting plane and having a cutting edge;

means for supporting said sliceable product on one side of said cutting plane;

a backstop member on the other side of said cutting plane;

means for advancing said sliceable product to position one end against said backstop member to establish the thickness of a slice;

means for moving said sliceable product supporting means along said cutting plane to cut a slice from said one end of said sliceable product;

backstop control means responsive to error in the weight of said cut slice for adjusting the spacing of said backstop member from said cutting plane in a direction to reduce said error in weight, in which said sliceable product supporting means includes a trough for supporting said sliceable product and movable through a fixed orbit adjacent said cutting plane, a rotatable air motor mounted on the end of said trough remote from said cutting plane, a pusher member supported for advancement along said trough and screw means connecting said air motor to said pusher member for moving same toward said backstop member, first limit sensing means mounted for adjustment along said trough near its end adjacent said backstop member and actuated by said pusher member for determining the length of the residual portion of the sliceable product to be left unsliced and enabling reversing of said air motor to cause same to retract said pusher member away from said backstop member and out of the way of loading of a new sliceable product, and second limit sensing means mounted adjacent the opposite end of said trough for stopping air motor retraction of said pusher member remote from said backstop member.

14. The machine of claim 13 in which said pusher member comprises a pusher plate engaging the sliceable product and a pressure fluid cylinder, said pressure fluid cylinder being responsive to actuation of said first limit sensing means and to the position of said trough in its orbit for advancing said pusher plate beyond the rest of said pusher member so as to eject said residual sliceable product length from said trough, said air motor being reversible thereafter in response to said actuation of said first limit switch and to the position of said trough.

15. The machine of claim 10 in which said sliceable product supporting means comprises a trough movable through a fixed orbit, clamp means and means for releasing same at a preselected location in said orbit for permitting said advancement of said sliceable product against said backstop member and thereafter actuating same at a second preselected location in said orbit for clamping said sliceable product fixedly in said trough for cutting.

16. The machine of claim 15 in which said clamp means comprises a plurality of air cylinders mounted in laterally spaced relation above said trough and each having means extensible for engaging exposed parts of said sliceable product and further means for shifting said plurality, as a unit, away from the trough to make room for loading a sliceable product.

17. The machine of claim 10 in which said backstop control means comprise a stepping motor rotatable in a forward direction to advance said backstop member toward said cutting plane and rotatable in a reverse direction to retract said backstop member away from said cutting plane.

18. The machine of claim 17 in which said slice weight monitoring means further comprises means for receiving a freshly cut slice and producing an electrical signal corresponding to the weight of said cut slice, means presettable by a human operator to produce an electrical signal corresponding to a desired reference weight, means for comparing said slice and reference weight signals to detect a difference therebetween, and means for actuating said stepping motor in said forward direction in response to a slice weight signal greater than said reference weight signal and in said reverse direction in response to a slice weight signal less than said reference weight signal.

19. A machine for removing slices from a sliceable product comprising:

a cutting member lying in a cutting plane and having a cutting edge;

means for supporting said sliceable product on one side of said cutting plane;

a backstop member on the other side of said cutting plane;

means for advancing said sliceable product to position one end against said backstop member to establish the thickness of a slice;

means for moving said sliceable product supporting means along said cutting plane to cut a slice from said one end of said sliceable product;

backstop control means responsive to error in the weight of said cut slice for adjusting the spacing of said backstop member from said cutting plane in a direction to reduce said error in weight, said backstop control means comprising a backstop motor actuable in a forward direction to advance said backstop member toward said cutting plane and actuable in a reverse direction to retract said backstop member away from said cutting plane, means for receiving a freshly cut slice and producing a signal corresponding to the weight of said cut slice, means presettable to produce a signal corresponding to a desired reference weight, means for comparing said slice and reference weight signals to detect a difference therebetween, and means for actuating said stepping motor in said forward direction in response to a slice weight signal greater than said reference weight signal and in said reverse direction in response to a slice weight signal less than said reference weight signal, in which said sliceable product support comprises a trough movable through an orbit, means responsive to said trough reaching a preselected position in said orbit for enabling said actuating of said backstop motor in response to difference between said slice weight and reference weight signals.

20. The machine of claim 10 in which said advancement of said sliceable product against said backstop is in a first direction along a first path at the front of the machine and substantially perpendicular to the cutting plane, said movement of said sliceable product to cut a slice being from front to rear along a second path parallel to said cutting plane, means beyond said cutting member along said second path for receiving and weighing a cut slice, conveyor means movable along a third path at the rear of the machine for receiving a cut slice from the weighing means, said movement along said third path being substantially parallel to said first path but in the opposite direction.

* * * * *